US006988630B2

(12) United States Patent
Matsumoto

(10) Patent No.: US 6,988,630 B2
(45) Date of Patent: Jan. 24, 2006

(54) STORAGE CONTAINER

(75) Inventor: Masaharu Matsumoto, Osaka (JP)

(73) Assignee: The Procter & Gamble Company, Cincinnati, OH (US)

( * ) Notice: Subject to any disclaimer, the term of this patent is extended or adjusted under 35 U.S.C. 154(b) by 226 days.

(21) Appl. No.: 10/602,144

(22) Filed: Jun. 24, 2003

(65) Prior Publication Data

US 2004/0050848 A1 Mar. 18, 2004

(30) Foreign Application Priority Data

Jun. 28, 2002 (JP) ..... 2002-190067

(51) Int. Cl.
*B65D 43/18* (2006.01)

(52) U.S. Cl. ..... 220/254.4; 220/824; 220/820; 220/259.1; 215/236; 222/557; 206/581; 206/823; 132/295; 132/300

(58) Field of Classification Search ..... 220/254.4, 220/259.1, 291, 820, 824; 215/236; 206/581, 206/823; 222/557; 132/295, 300, 293
See application file for complete search history.

(56) References Cited

U.S. PATENT DOCUMENTS

| | | | | | |
|---|---|---|---|---|---|
| 1,575,097 | A | * | 3/1926 | Conner, Jr. | 220/820 |
| 1,998,373 | A | * | 4/1935 | Love | 220/254.4 |
| 2,358,194 | A | * | 9/1944 | White | 220/821 |
| 2,401,127 | A | * | 5/1946 | Younghusband | 132/293 |
| 3,235,145 | A | * | 2/1966 | Spier | 222/478 |
| 3,352,445 | A | * | 11/1967 | Cochin | 220/291 |
| 3,441,033 | A | * | 4/1969 | Flax | 132/295 |
| 4,183,443 | A | * | 1/1980 | DeParales et al. | 220/714 |
| 4,807,773 | A | * | 2/1989 | Tsai | 220/4.27 |
| 5,632,394 | A | * | 5/1997 | Mecca et al. | 220/824 |
| 5,884,636 | A | * | 3/1999 | Sheffler et al. | 132/295 |
| 5,950,638 | A | * | 9/1999 | Crosta | 132/293 |
| 5,975,093 | A | * | 11/1999 | Joulia | 132/293 |
| 6,009,885 | A | * | 1/2000 | Nam | 132/293 |
| 6,070,749 | A | * | 6/2000 | Joulia | 220/4.22 |
| 6,223,921 | B1 | * | 5/2001 | Huang | 220/4.27 |
| 6,332,551 | B1 | | 12/2001 | Copeland | |
| 6,336,460 | B2 | * | 1/2002 | Yuhara | 132/295 |
| 6,378,533 | B1 | * | 4/2002 | Roman | 132/295 |
| 6,382,410 | B1 | * | 5/2002 | Magid et al. | 206/38.1 |
| 6,540,083 | B2 | * | 4/2003 | Shih | 206/581 |
| 6,547,102 | B2 | * | 4/2003 | Stoneberg | 222/143 |
| 6,772,899 | B2 | * | 8/2004 | Delmon | 220/263 |

FOREIGN PATENT DOCUMENTS

| | | | | |
|---|---|---|---|---|
| EP | 1350441 | A1 | * | 10/2003 |
| JP | 05-005014 | U | | 1/1993 |
| JP | 2002002742 | A2 | | 1/2002 |
| JP | 2003116628 | A | * | 4/2003 |
| WO | WO 3055765 | A1 | * | 7/2003 |

* cited by examiner

*Primary Examiner*—Nathan J. Newhouse
*Assistant Examiner*—James N. Smalley
(74) *Attorney, Agent, or Firm*—Eileen L. Hughett; John M. Howell; Brian M. Bolam

(57) ABSTRACT

A storage container which is opened and closed by horizontally rotating a lid body with regard to the container body, having a rotating torque such that the lid body has a suitable resistance feel when rotating, and at the same time, makes a technical issue of the setting of the lid body rotation limits, so that the rotation of the lid body with regards to the container body will be reinforced, so that a fulfilling feeling during use can be obtained, and which has a storage section with functions appropriate to the storage material being stored.

10 Claims, 12 Drawing Sheets

STORAGE CONTAINER

BRIEF SUMMARY OF THE INVENTION

The present invention relates to a storage container wherein a lid body is rotated horizontally with regards to a container body which stores the material to be stored, in order to open and close the container body.

BACKGROUND OF THE INVENTION

Figure 1:
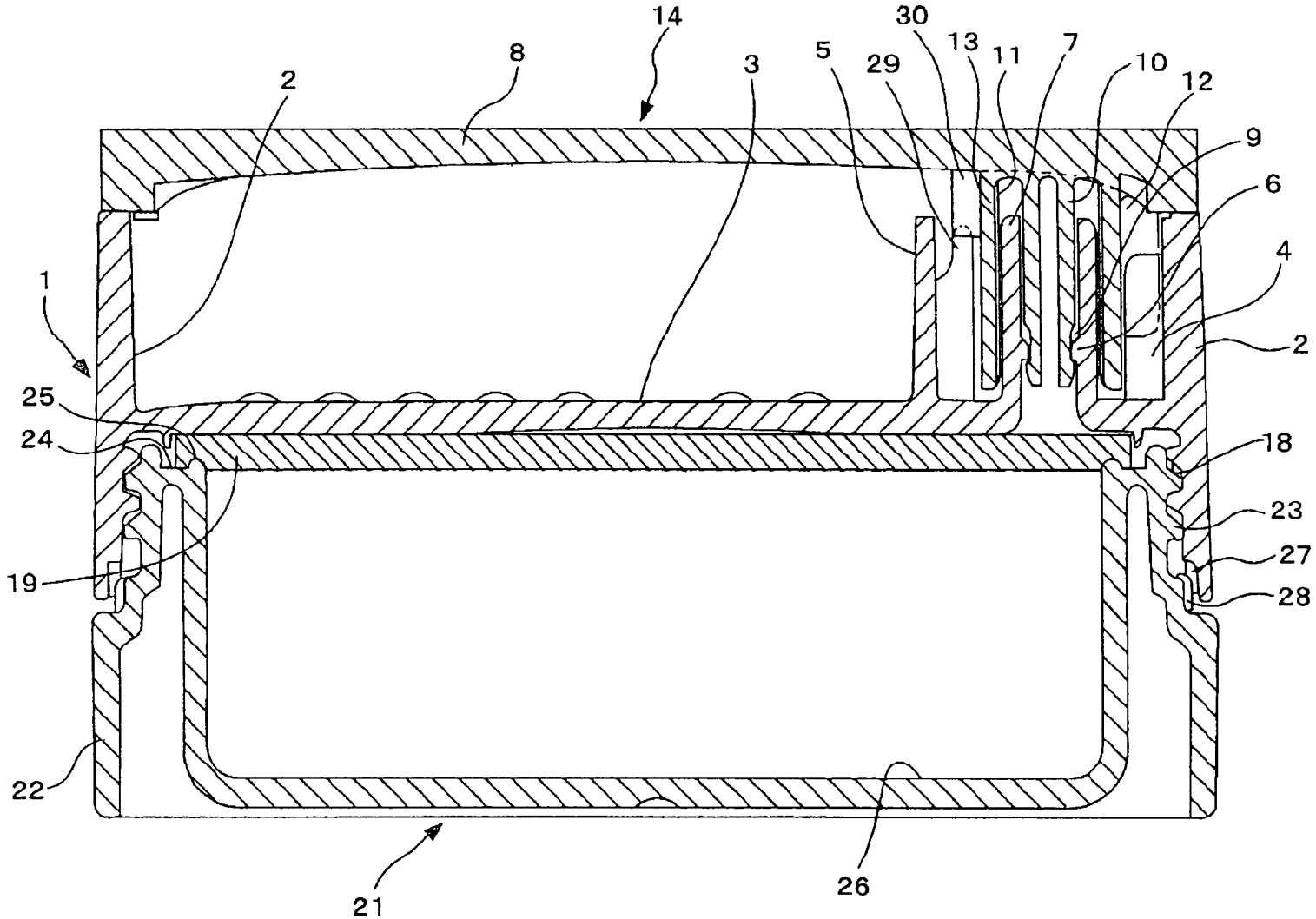
FIG. 1: A longitudinal cross-section drawing of the storage container showing the first preferred embodiment of the present invention.
Figure 2:
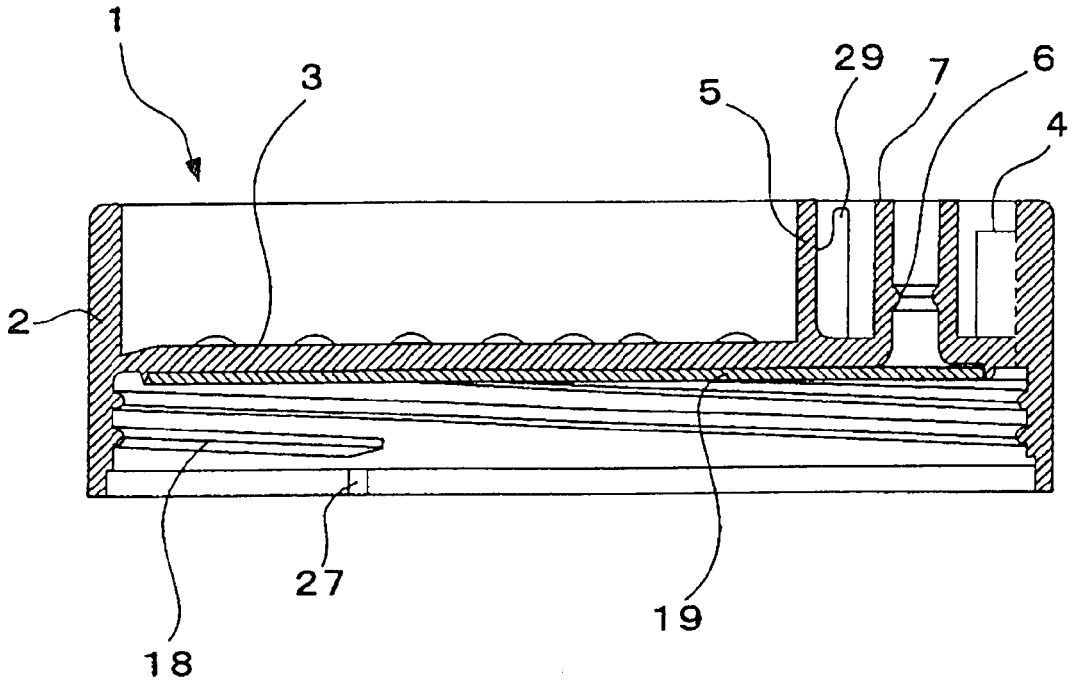
FIG. 2: A longitudinal cross-section drawing of the container body shown in FIG. 1.
Figure 3:
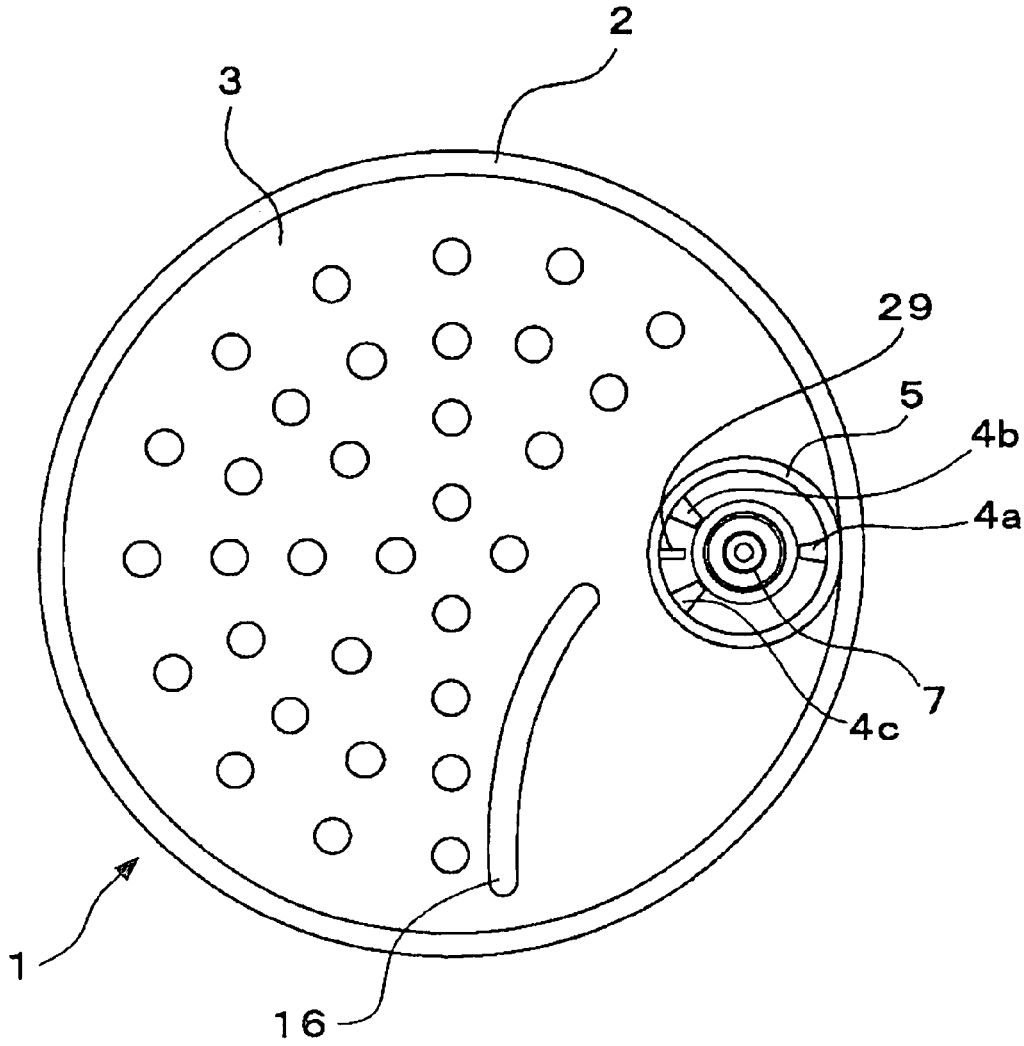
FIG. 3: A top view drawing of the container body.
Figure 4:
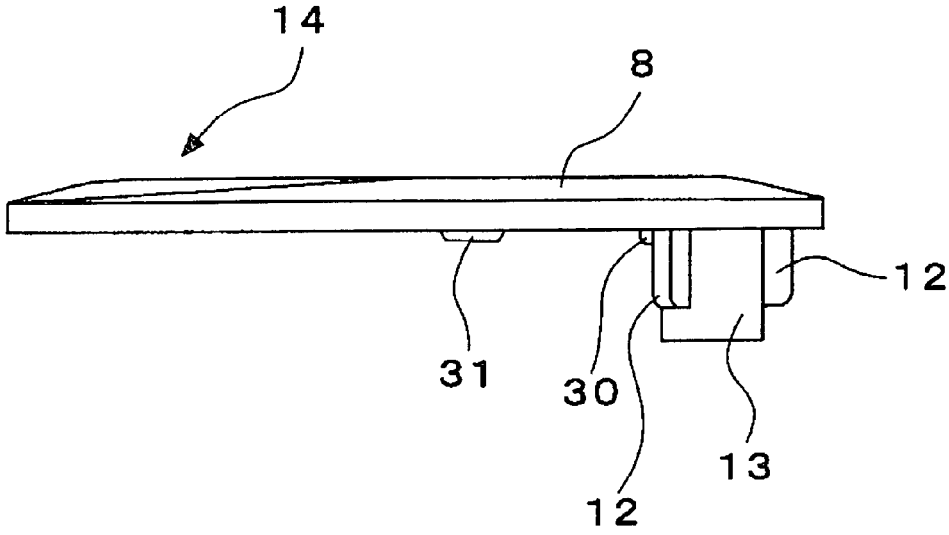
FIG. 4: A side view drawing of the lid body shown in FIG. 1.
Figure 5:
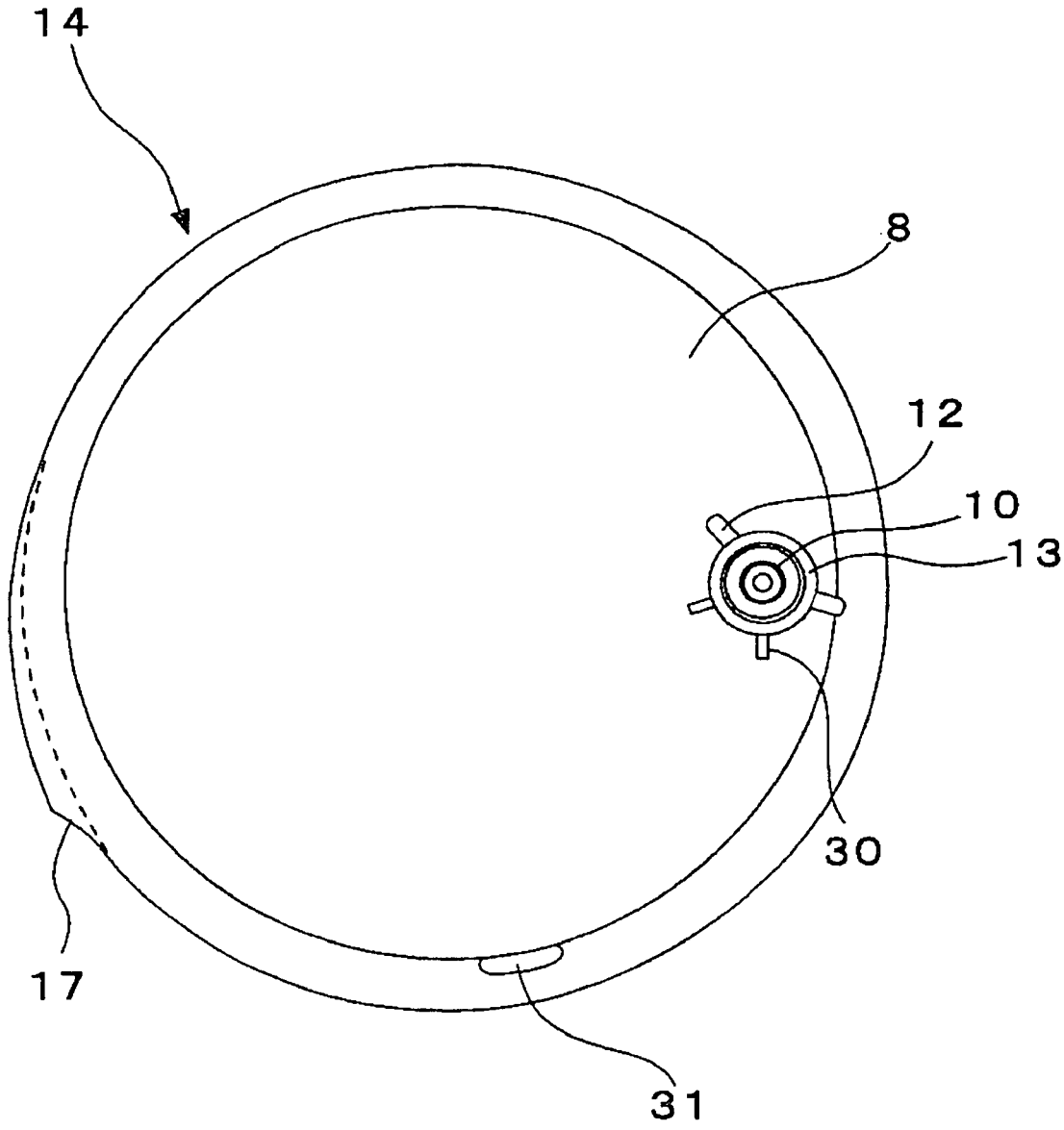
FIG. 5: A side view drawing of the lid body.
Figure 6:
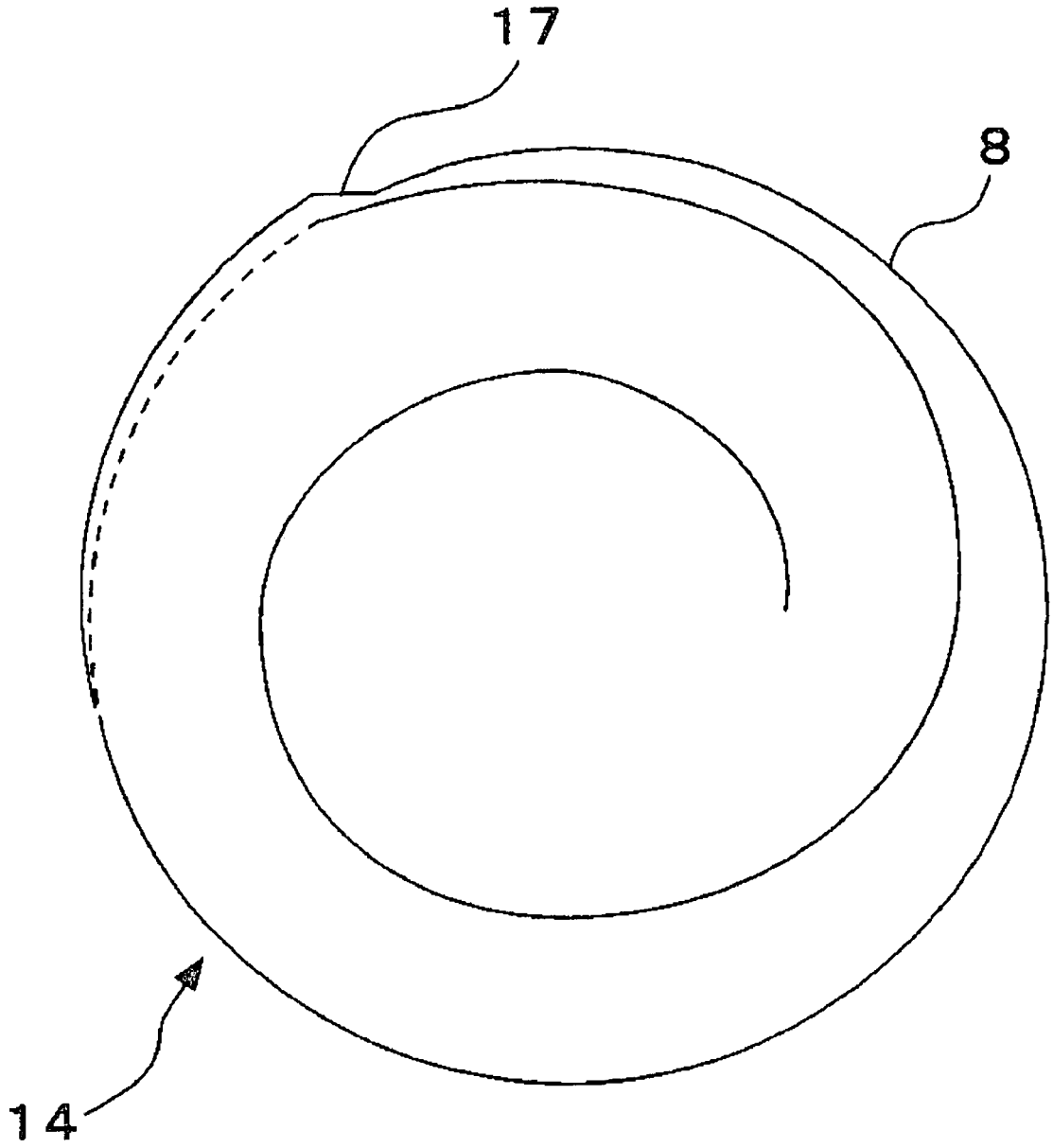
FIG. 6: A top view drawing of the lid body.
Figure 7:
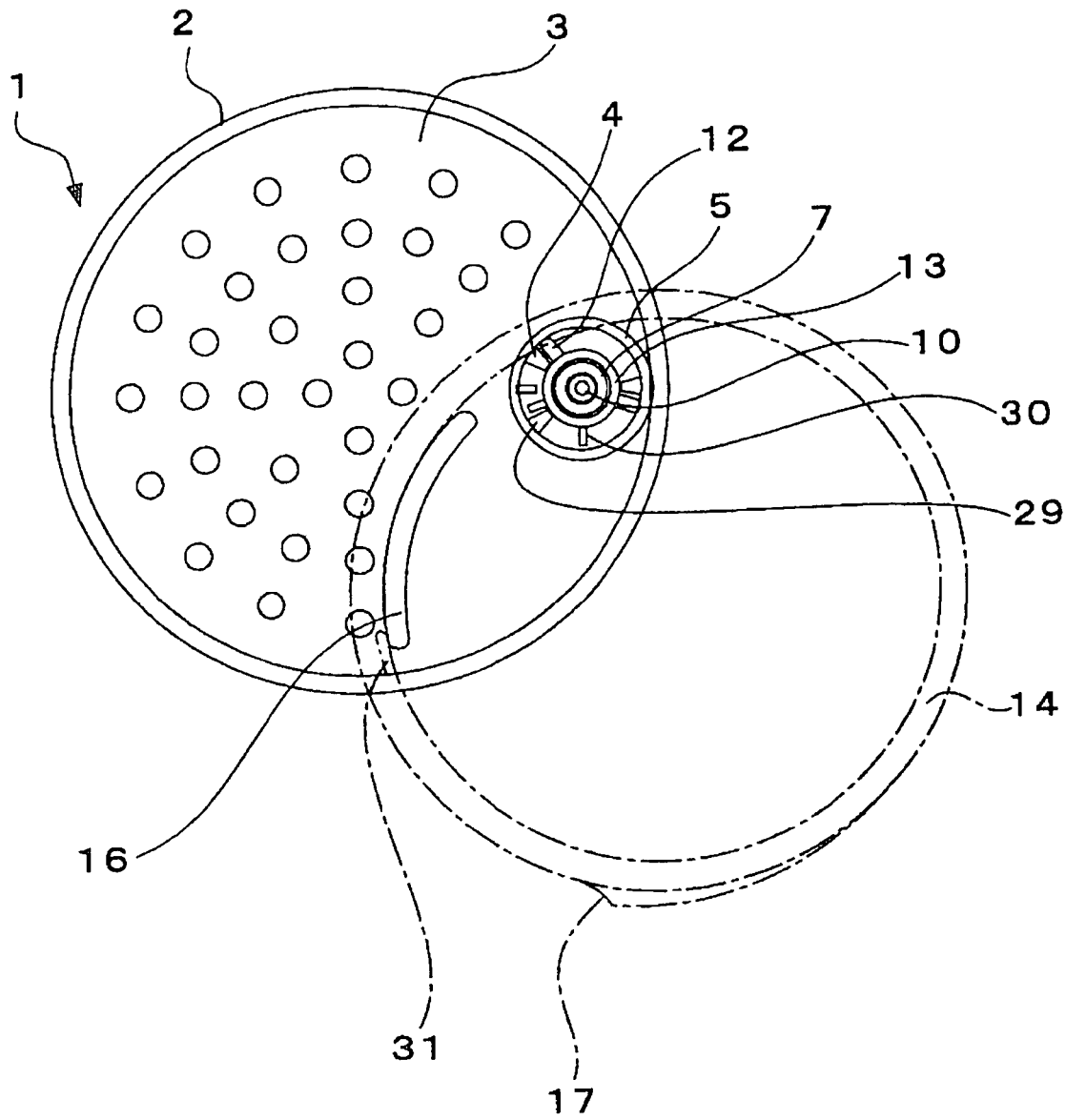
FIG. 7: A top view drawing showing the condition of the lid body assembled to the container body.
Figure 8:
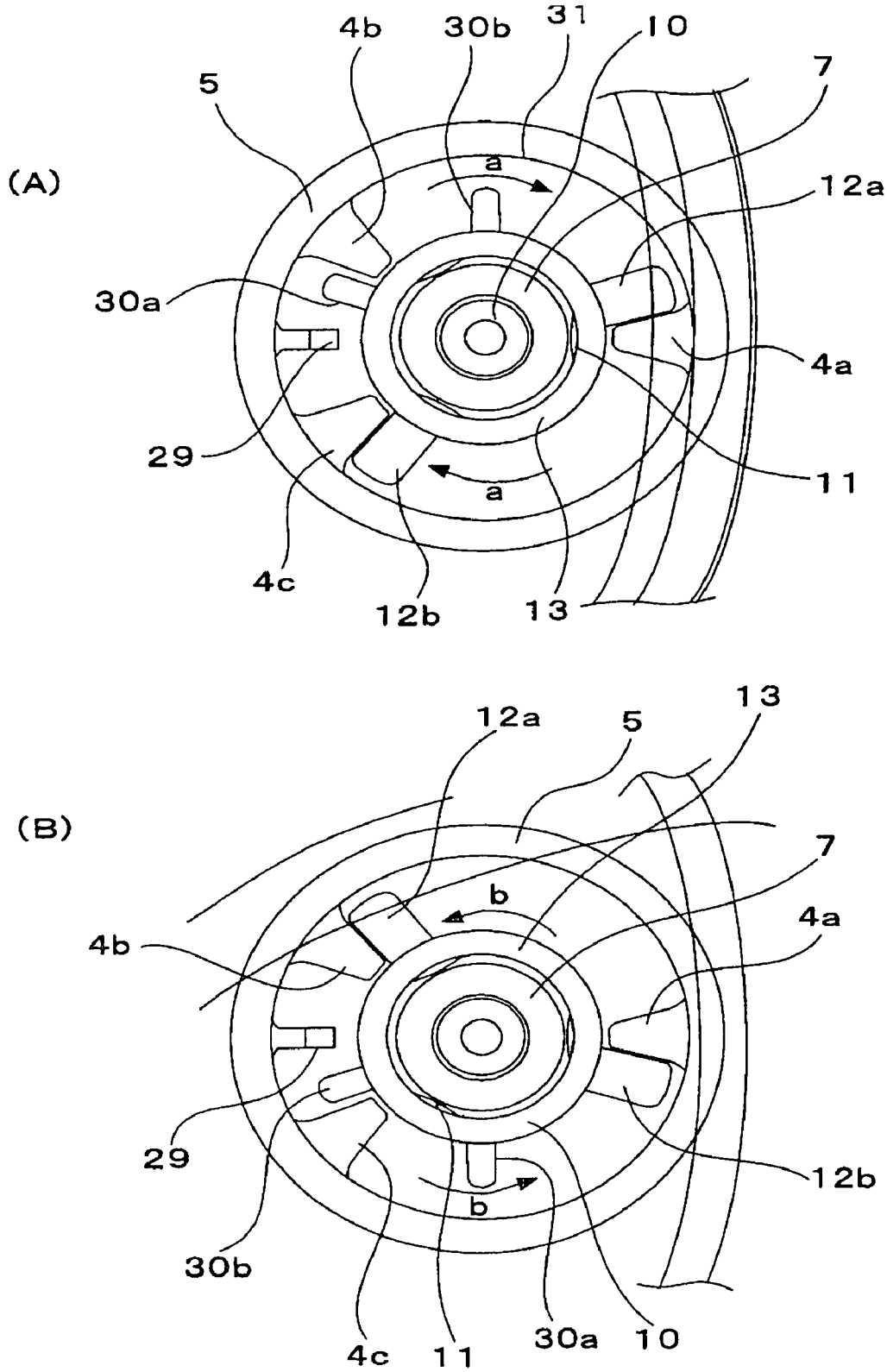
FIG. 8: (A) A description drawing showing the condition of the rotation tube and cylindrical pin of the lid body and the tubular shaft and small cylinder of the container body at the open rotational limit. (B) A description drawing showing the condition of the rotation tube and cylindrical pin of the lid body and the tubular shaft and small cylinder of the container body at the closed rotational limit.
Figure 9:
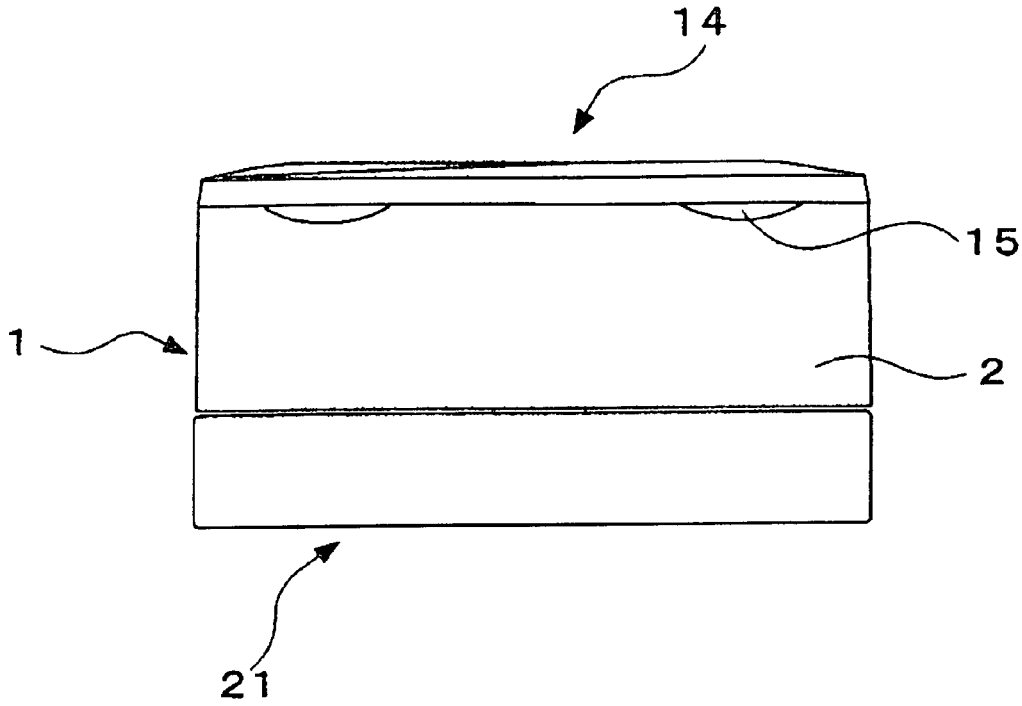
FIG. 9: A side view drawing of the storage container shown in FIG. 1.
Figure 10:
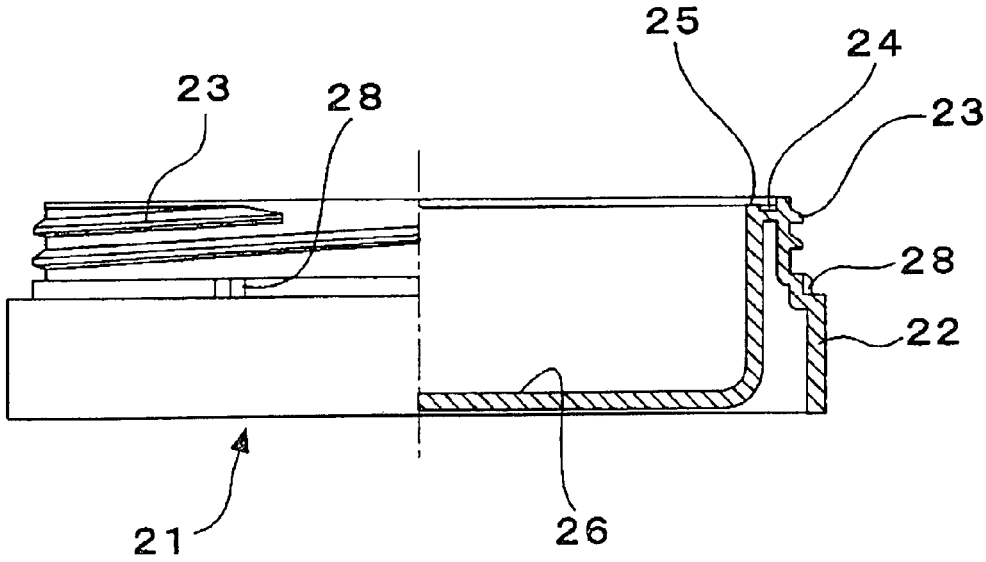
FIG. 10: A half longitudinal cross-section drawing of the number 2 container body shown in FIG. 1.
Figure 11:
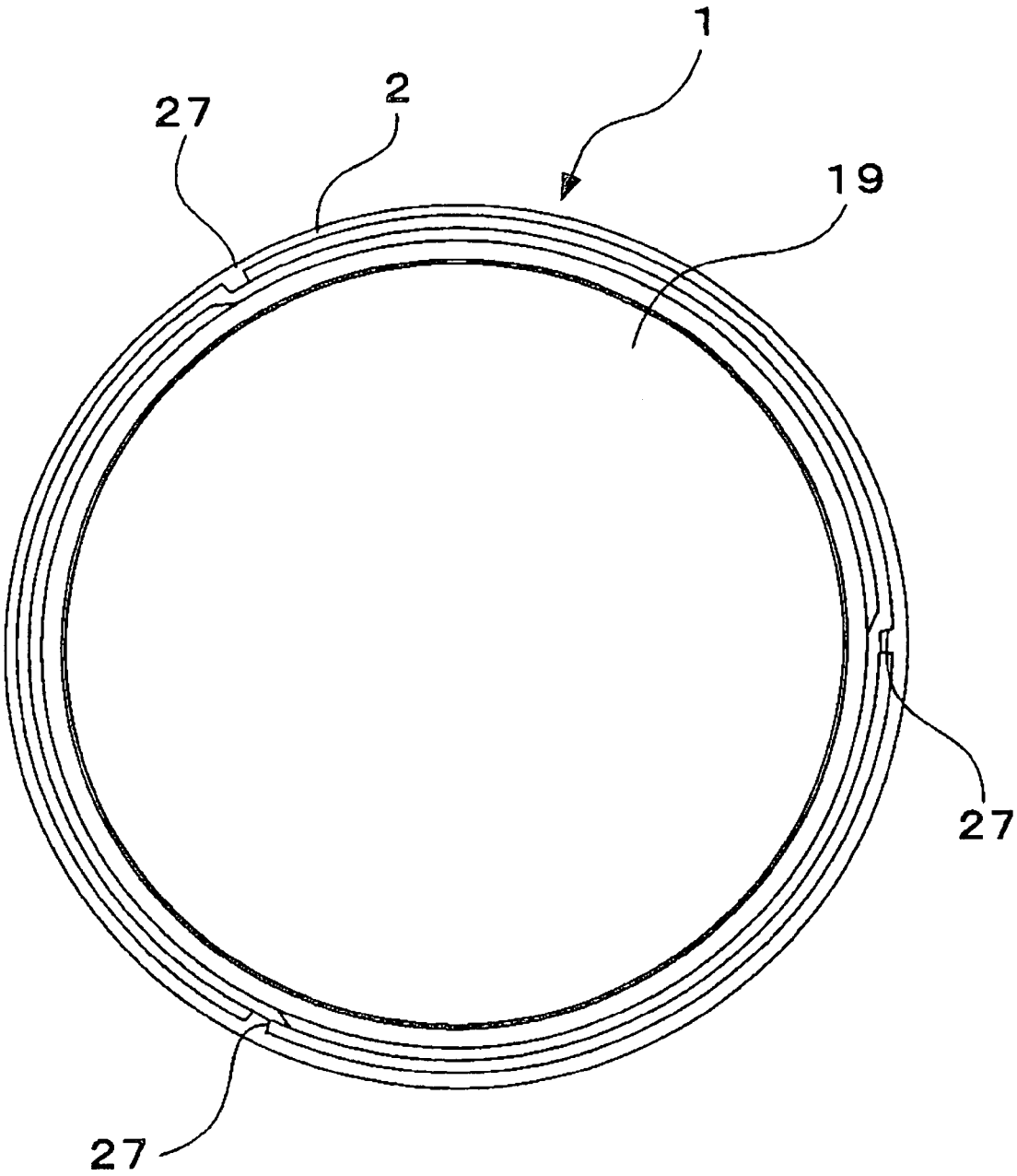
FIG. 11: A bottom view drawing of the container body shown in FIG. 1.
Figure 12:
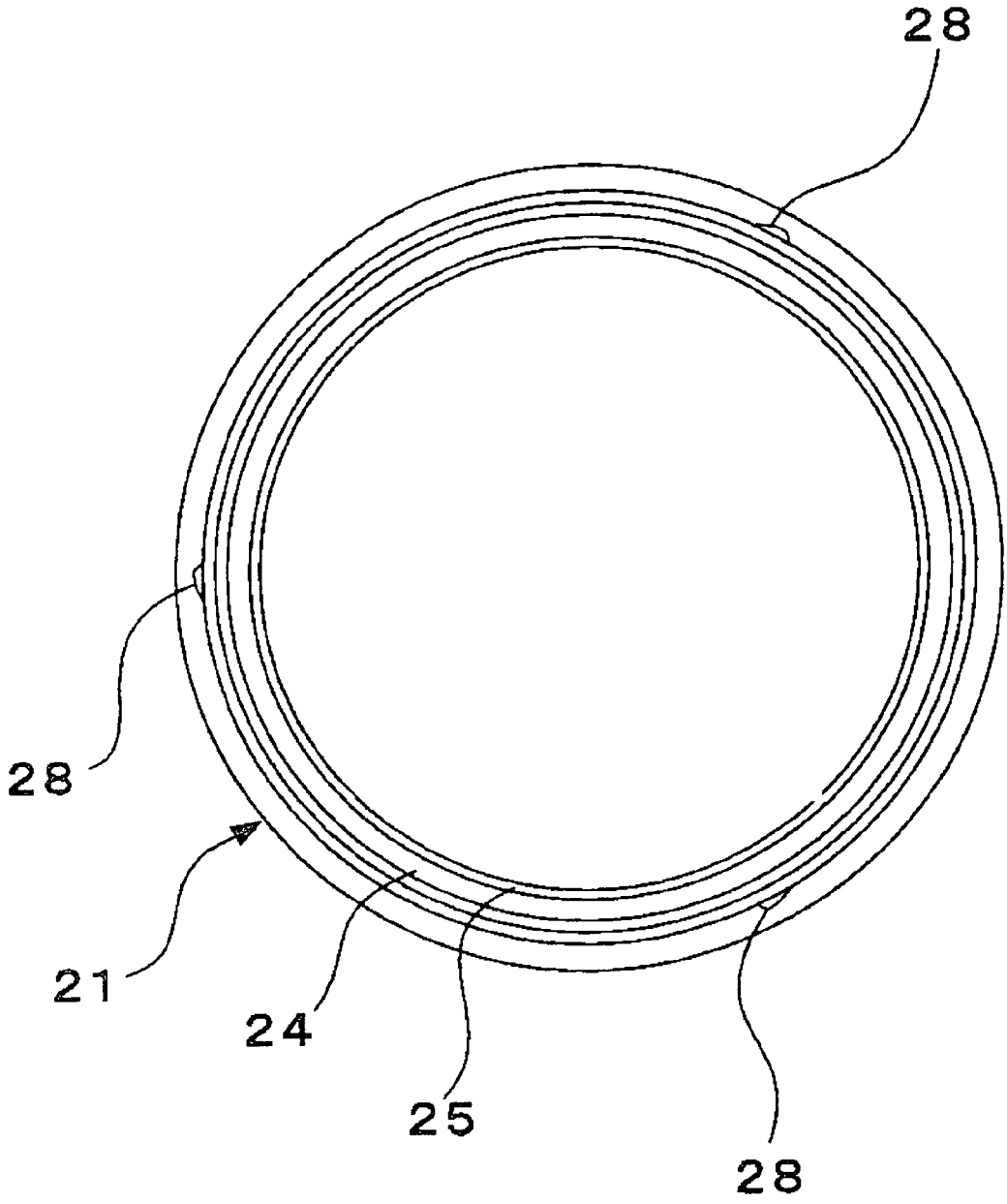
FIG. 12: A top view drawing of the number 2 container body.
Figure 13:
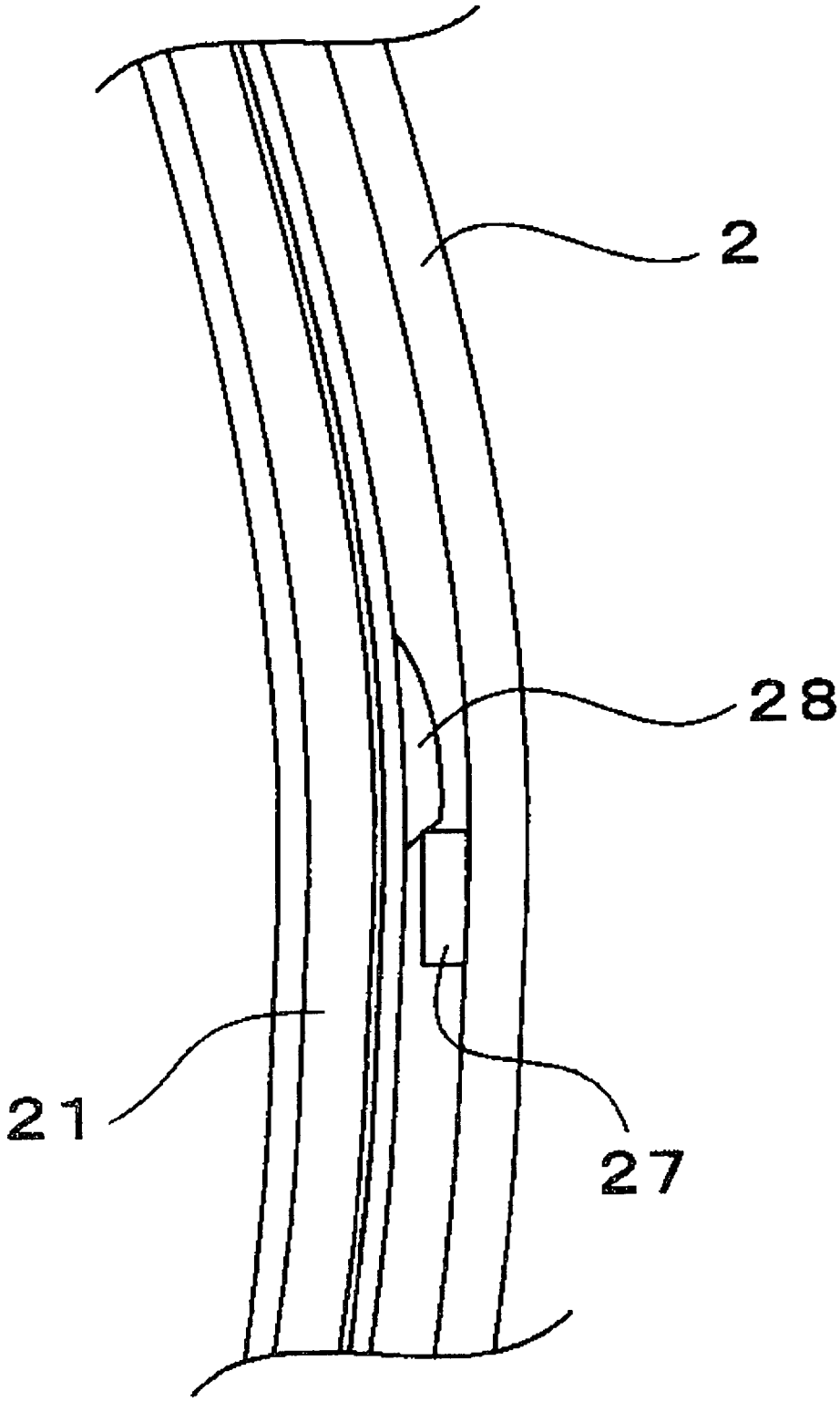
FIG. 13: A description drawing showing the locked condition of the ride over locking parts of the number 2 container body and the protrusions of the container body.

To illustrate, storage containers which are containers for cosmetics or the like are known which have a storage part which stores the cosmetic material and a storage part which stores the cosmetic puff applicator, and the member which functions as the lid is rotated horizontally in order to open and close the container.

This type of container has a support shaft for rotating in the lid body, and one container body side has a hole for receiving the support shaft of the lid body, and the container is opened or closed by rotating the lid body in the horizontal direction with the lid body support shaft at the center.

In patent disclosure 2002-2742, an airtight container is described wherein, with regards to a container body, an inner lid is rotated horizontally with a rotation support shaft at the center in order to open or close a container body which stores the cosmetic material or the like, wherein the cosmetic puff applicator or the like is stored above the closed inner lid, and an outer lid is made to cover said inner lid, and said outer lid is screwed together to the container body, and the screwing force when screwing the outer lid provides an effect on the inner lid in order to improve the sealed condition of the container body opening.

With this airtight container, a large radius cone section is formed in the inner lid with the taper section which tapers off toward the tip end, a rotation support shaft is established with a dividing groove in the longitudinal direction in the center region of said cone section, and one container body is structured with a section with diameter increasing toward the bottom, and a mating hole connected to said diameter increasing section to form a step section. For the inner lid, the rotating support shaft is inserted into the mating hole of the container body, and the cone section of the rotating support shaft increases in diameter in the mating hole so that the cone section with increased diameter is locked on the step section of the mating hole to make a closed condition, and the inner lid rotates with regards to the container body with the rotating support shaft at the center.

DETAILED DESCRIPTION OF THE INVENTION

However, with containers which are opened and closed by horizontally rotating a lid body with regards to the container body, the rotational torque of the lid body is determined by the friction between the rotating support shaft and the mating hole, but it is difficult to obtain a proper rotational torque which has appropriate resistance and feels good, using only friction between the rotational support shaft and the mating hole.

There is also the problem that when the friction between the lid rotation support shaft and the container body mating hole is increased in order to obtain the appropriate resistance feel, a large load will be applied to the rotating support shaft which rotates and to the mating hole when the lid body is opened and closed, and because of this load, the connecting section of the rotational support shaft and the mating hole can easily be damaged.

Furthermore, the rotational direction of the lid plate with regard to the container body is not determined, and if the lid body can be rotated 360° with regard to the container body, it is possible that even though the lid plate has been opened, by some means it may become closed again, and the opening and closing condition of the lid body will be unstable, and because it is not possible to have a positive feel when the lid opens or closes, there will be no satisfaction when the storage container is used, and it will not be possible to have a good feeling when using the storage container.

Also, when the lid body is opened by rotating 180° with regards to the container body, the container body and the lid body are supported by the connection between the rotation support shaft and the mating hole only in the region where the container body and lid body are overlapping, and if some force is applied to the lid body in this condition, a gap will form in the bottom section and the lid body will be easily damaged.

Furthermore, when storing two different materials like cosmetic material and cosmetic puff applicators, it is possible than an airtight seal will be required for the container which stores the cosmetic material, and a breathable container will be required for the storage of the cosmetic puff applicator, so that different functions will be required from a single storage container.

Therefore, the present invention was created after considering the above-mentioned problems, and the purpose is to provide a storage container which is opened and closed by horizontally rotating a lid body with regard to the container body, which has a rotating torque such that the lid body has a suitable resistance feel when rotating, and at the same time, makes a technical issue of the setting of the lid body rotation limits, so that the rotation of the lid body with regards to the container body will be reinforced, so that a fulfilling feeling during use can be obtained, and which has a storage section with functions appropriate to the storage material being stored.

In order to resolve the above problems, the invention shown in Claim 1 is a storage container comprising:

a container body which has a tubular wall, a bottom wall on said tubular wall, a small cylinder which has at least one locking part protruding from the inner wall which establishes a rotation limit, and a tubular shaft which has a smaller diameter than said small cylinder and which has a locking protrusion ring which protrudes inward from the lower inner wall; and a lid which has a lid plate which closes off said tubular shaft, a cylindrical pin in the lower surface of said lid plate which mates with said tubular shaft and which has a locking protrusion ring which locks with said locking protrusion ring, a torque adjusting protrusion to the outer side of said cylindrical pin with an inner wall which rubs against the outer wall of said tubular axle in the longitudinal direction to control rotational torque, and a rotation tube which hangs down and locks around said tubular axle and which has at least one locking tab on the outer wall which locks onto said locking part, such that the lid plate rotates horizontally with regards to the container body because of the relative rotation of said cylindrical pin to said tubular shaft and said tubular shaft to the rotation tube.

With the invention shown in Claim 1, the cylindrical pin of the lid body has a slightly decreasing diameter while the tubular shaft of the container body has a slightly increasing diameter, a cylindrical pin is mated into said tubular shaft, such that the locking ring on the lower inner wall of the tubular shaft and the locking ring in the lower outer wall of the cylindrical pin interlock, and the container body and the lid body are connected so as to freely rotate.

Along with the mating between cylindrical pin of the lid body and the tubular shaft of the container body, the rotation tube of the lid body mates around said tubular shaft, and torque adjusting protrusions established on the inner wall of said rotation tube rub against the outside wall in the longitudinal direction of the cylindrical shaft in order to create a rotational torque with suitable resistance feel when rotating the lid body.

The lid plate of the lid body horizontally rotates with regard to the container body to open and close with a suitable resistance feel because of the relative rotation between the cylindrical pin of the lid body to the tubular shaft of the container body and the relative rotation between said tubular shaft and the rotation tube of the lid body.

Because of the double construction between the cylindrical pin of the lid body to the tubular shaft of the container body and said tubular shaft to the rotation tube of the lid body, the strength is increased.

Along with the mating of the cylindrical pin of the lid body to the tubular shaft of the container body and said tubular shaft to the rotation tube of the lid body, a locking piece which protrudes from the outer wall of said rotation to contacts with the locking part established in the inner wall of the small cylinder of the container body, rotation of the lid body with regards to the container body is restricted, and the rotational limits of the lid body is set.

The invention shown in Claim 2 has, in addition to the structure of the invention of Claim 1, a number 2 container body wherein a bottom wall of a container body is established near the center in the longitudinal direction of tubular wall, and an attaching part is established on the lower part of the inner wall of said bottom wall, said number 2 container body having an outer tubular member with nearly the same shape as said container body, a storage part inside of said outer tube, and screw threads which mates into and attaches to said screw grooves.

The number 2 container body can be attached to the bottom part of the container body, and the bottom wall of the container body functions as the lid body of the No. 2 container body, and because the storage container can have two compartments established, different types of storage materials which are used at the same time, such as cosmetic materials and cosmetic puff applicators, can be stored in one storage container, which is convenient.

The invention shown in Claim 3 has, along with the structure of the inventions of Claim 1 and 2, a pair of locking tabs with an opening angle of less than 180 which are established in the rotation tube of the body, a protrusion establishes the closing rotational limit and contacts in the rotational direction one of the locking tabs on a small cylinder of the container body, a protrusion which establishes the opening rotational limit, and a protrusion which protrudes and contacts in the rotational direction the other locking tab at said opening and closing rotational limit.

With the invention shown in Claim 3, one of the locking pieces of the lid body contacts one of the locking parts of the container body which establishes the rotation limits at the closing rotation limit and at the opening rotation limit, and at the same time, at opening angles of less than 180°, the other locking part of the container body and the other locking parts of the lid body contacts in order to stop rotation of the lid body in a stable condition.

The invention shown in Claim 4 has, along with the structure of the inventions of Claim 1, 2, and 3, at least one concave section established at the upper edge of the tubular wall of the container body to form a gap with the lid body at the closing rotation limits.

With the invention shown in Claim 4, a concave section which forms a gap with the lid body at the close rotational limits is established at the upper edge of the tubular wall of the container body, so this gap functions as a passage hole for air, so that for the case of a cosmetic puff applicator for instance, mold will not easily form on the cosmetic puff applicator because of the breathable properties. The concave section established in the container body is not restricted to a single concave section, but rather it is acceptable to use multiple concave sections in consideration of the breathable properties for air.

The invention shown in Claim 5 has, along with the structure of the inventions of Claim 1, 2, 3, and 4, a stopping piece which stops movement of the stored material which is stored inside said container body, and is established in the bottom wall of container body immediately below the outer edge of lid body which overlaps container body at the opening rotational limit.

With the invention shown in Claim 5, the movement of stored material is stopped by the stopping piece established in the bottom wall, and removal of the stored material from the container body is made easy because the stored material will not move to the region where the lid body and the container body are overlapping.

The invention shown in Claim 6 has, along with the structure of the inventions of Claim 1, 2, 3, 4, and 5, a slightly protruding hooking part is established in the outer edge of lid plate of lid body protruding in the outer direction from container body.

With the invention shown in Claim 6, the lid body in the closed condition can easily be rotated to open using the hooking part slightly protruding from the container body as a finger hold.

The invention shown in Claim 7 has, along with the structure of the inventions shown in Claim 2, 3, 4, 5, and 6, a screw groove which is cut into the inner wall of the tubular wall in the lower part of the bottom wall of the container body, a packing piece is established in the lower surface of said bottom wall, a screw ring which screws to said screw groove is established in the outer wall of outer tube of No. 2 container body, a protrusion ring forms an inner flange shaped step region positioned slightly below the top edge of said outer tubular body while pressing on said packing piece through said step region in the closed condition, and a concave shaped storage part is connected from said protrusion ring.

With the invention shown in Claim 7, if the number 2 container body is screwed on to the lower part of the bottom wall of the container body, the protrusion ring of the No. 2 container body will apply a consistent pressure on to the packing piece when the No. 2 container body is in the closed condition so that the No. 2 container body can be connected in an airtight manner to the container body.

Therefore, the container body and the No. 2 container body will have different functions, for instance, cosmetic materials or the like which require airtight conditions are stored in the No. 2 container body, and the cosmetic puff applicator which requires a breathable container can be stored in the container body.

The invention shown in Claim 8 has, along with the structure of the invention shown in Claim 7, a protrusion which protrudes inward from the inner wall lower edge of the tubular wall of the container body, and an ride over locking part which protrudes to ride over said protrusions and produces a sound to notify that the container body and the No. 2 container body are screwed together.

With the invention shown in Claim 8, the ride over locking part of the No. 2 container body rides up over a protrusion of the container body to make a sound immediately prior to the completion of screwing together the container body and the No. 2 container body, and when the ride over locking part has completed riding over the protrusion, the screwing together of the container body and the No. 2 container body is complete, so the user can know that the No. 2 container body is attached in an airtight manner to the container body by the sound generated.

The invention shown in Claim 9 has, along with the structure of the inventions shown in Claim 1, 2, 3, 4, 5, 6, 7, and 8, a sound outputting protrusion piece which protrudes from the inward side of the small cylinder of the container body, and has a top edge which can vibrate in the circumferential direction, and a protrusion piece protruding from the lid body which pushes aside said sound outputting protrusion piece to generate sound.

With the invention shown in Claim 9, a protrusion piece in the lid body pushes away the sound outputting protrusion piece of the container body in order to create a sound along with rotation of the lid body, so the user can audibly determine whether the lid body is in an open or closed rotational condition. The protrusion piece which pushes away the sound outputting protrusion piece is not restricted to just a single piece, but multiple pieces can be established, and for instance, it is possible to produce a sound at the beginning of rotation and upon completion of rotation.

Invention shown in Claim 10 has, along with the structure of the invention shown in Claim 1, 2, 3, 4, 5, 6, 7, 8, and 9, a locking protrusion piece which protrudes from the lower surface of the lid body to contact the upper edge of tubular wall of container body at the opening rotational limit of the lid body.

The lid body is positively made to stop rotating by the interlocking of the two locking parts of the lid body with the two locking parts of the container body, and the same time, because the locking pieces of the lid body contact the tubular wall of the container body, the horizontal opening rotating action on the lid body can be stopped in a stable manner so that the open condition can be maintained.

The present invention will be described below while referring to the drawings.

Drawing 1 is a longitudinal cross-section drawing showing the storage container. As shown in Drawing 1, the storage container is comprised of container body 1, lid body 14 which opens and closes container body 1 and No. 2 container body 21 which is attached to the bottom of container body 1.

Drawing 2 is a longitudinal cross-section drawing showing container body 1, and Drawing 3 is a top view drawing of container body 1. As shown in Drawing 2 and Drawing 3, container body 1 has a bottom wall 3 established near the center of cylindrical tubular wall 2, and the storage part which stores and material to be stored is comprised of tubular wall 2 and bottom wall 3.

The inner wall of tubular wall 2 of the lower part of bottom wall 3 has screw grooves 18 which become the attaching part to attach No. 2 container body 21. The bottom edge of tubular wall 2 has protrusions 28 which protrude inward. Furthermore, the lower surface of bottom wall 3 has a packing piece 19.

The upper surface of said bottom wall 3 has a small cylinder 5 standing upward with three locking parts 4 (4*a*, 4*b*, 4*c*) on the inner wall which establish the rotational limit of lid body 14. Locking parts 4 are established such that locking part 4*c* sets the closing rotational limit of lid body 14, locking part 4*b* sets the opening rotational limit, and locking part 4*a* is established at the same angle as the opening angle of lid body 14 which is less than 180° with regards to locking part 4*c* or locking part 4*b*. The interval between locking part 4*b* and locking part 4*c* has a sound outputting protrusion which can vibrate in the circumferential direction. Locking parts 4 are formed with a trapezoidal shaped lateral cross-section with two contact surfaces.

The inner side of small cylinder 5 has a tubular shaft 7 standing upward and surrounding locking protrusion ring 6 which protrudes inward from the lower part of the inner wall. Furthermore, a stopping piece 16 is established protruding from the upper surface of bottom wall 3 which becomes the circumferential edge position of the open rotational limit of lid plate 14.

Drawing 4 is a side view drawing of lid body 14, Drawing 5 is a bottom view drawing of lid body 14, and Drawing 6 is a top view drawing of lid body 14. As shown in Drawing 4 through Drawing 6, lid body 14 has a lid plate 8 with nearly the same diameter as tubular wall 3 and cylindrical pin 10, which fits into tubular shaft 7 of container body, 1 hangs downward from the lower surface of said lid plate 8. The lower part of the outer wall of said cylindrical pin 10 has a locking ring 9 which locks to locking protrusion ring 6 of tubular shaft 7

The outward side of cylindrical pin 10 has a rotation tube 13 which hangs downward and meets with tubular shaft 7. The inner wall of rotation tube 10 rubs along tubular shaft 7 and outer wall in the longitudinal direction, and torque adjusting protrusions 11 are established between tubular shaft 7 and rotation tube 13, in order to adjust the rotational torque.

The outer wall of rotation tube 13 has a pair of locking pieces 12 (12*a*, 12*b*) which contact the locking parts 4 of container body 1 at the opening rotational limit and closing rotational limit of lid body 14, and a protrusion piece 30 which creates a noise when pushing away the noise output protrusion piece 29 when rotating lid body 14. Locking pieces 12 are formed in a plate configuration with a surface which contacts the contact surface of locking parts 4 of container body 1.

The outer edge of the lower surface of lid plate 8 has a locking protrusion piece 31 which contacts the top edge of tubular wall 3 of container body 1 from the opening rotational direction at the opening rotational limits of lid body 14.

Furthermore, as shown in Drawing 6, lid body 14 has hooking parts 17 on the outside edge of lid plate 8 which protrude slightly from the tubular wall 2 of container body 1.

Drawing 7 is a top view drawing showing container body 1 with lid body 14 attached in the open rotational limit condition. Cylindrical pin 10 of lid body 14 has a slight diameter reduction while the tubular shaft 7 has a slight diameter increase, and the locking protrusion ring 11 of cylindrical pin 10 is fit into tubular shaft 7 locked to locking protrusion ring 6 of tubular shaft 7 in a condition which can freely rotate.

Along with the mating of tubular shaft 7 and cylindrical pin 10, in the condition where torque adjusting part 11, which is established on the inner wall of rotation cylinder 13, is rubbing against the outer wall in the longitudinal direction of tubular shaft 7, rotation tube 13 fits around tubular shaft 7. The rotational torque of tubular shaft 7 and rotation tube 13 is set to have a suitable resistance feel by the torque adjusting part 11.

Lid plate 8 of lid body 14 rotationally slides horizontally with regards to container body 1 with a suitable resistance feel because of the relative rotation of cylindrical pin 10 to tubular shaft 7 and said tubular shaft 7 to rotation shaft 13. At this time, hooking parts 17, which protrude slightly from container body 1, function as fingerholds, so that lid plate 8 which has nearly identical diameter to the tubular wall 2 of container body 1 can be rotated horizontally.

Because of the double structure of the cylindrical pin 10 to tubular shaft 7 and tubular shaft 7 to rotation tube 13, the strength is increased and the durability and safety of the storage container is increased.

Drawing 8 (A) shows the condition of container body 1 and lid body 14 at the closed rotational limit, and Drawing 8 (B) shows the condition of container body 1 and lid body 14 at the open rotational limit. As shown in Drawing 8 (A), with lid body 14 at the closed rotational limit, locking piece 12*b* contacts from the closed rotational direction with locking part 4*c* to establish the closed rotational limit, locking piece 12*a* contacts from the closing rotational direction with locking part 4*a* which stands up at a position with the same angle as the opening angle of lid body 14, so that the rotation of lid body 14 is stably stopped. In the drawing, arrow a points in the closing rotational direction.

When lid body 14 is rotationally opened, locking piece 12*a* moves and contacts from the opening rotational direction locking part 4*b* which establishes the opening rotational limit, and locking piece 12*b* contacts locking part 4*b* from the opening rotational direction, so that the rotation of lid body 14 is stably stopped. In the drawing, arrow b points in the opening rotational direction.

At the rotational limit of lid body 14, the pair of locking parts 4 and the pair of locking pieces 12 contact together at the opening angle, and the rotation of lid body 14 is stably stopped, so the user can feel the closing rotational limit and the opening rotational limit of lid body 14, so that a stable and favorable feel of use can be obtained. Because locking parts 4 and locking pieces 12 make surface contact, the rotation of lid body 14 can positively be stopped.

Even if an unreasonable force is applied to lid body 14, because of lever action, and with the connecting region between cylindrical pin 10 and tubular shaft 7 as well as said tubular shaft 7 and rotation tube 13 as a support point, the force applied to the contact region of 1 pair of locking part 4 and locking piece 12 will be received and stopped by the other pair of locking part 4 and locking piece 12 which are in the opposite side in the radial direction, so the effective force is not applied to only one pair of locking part 4 and locking piece 12 because of the lever action, and therefore the durability and safety of the storage container is increased.

Bottom wall 3 of container body 1, which is directly below the circumferential edge of lid body 14 which overlaps container body 1 at the opening rotational limit, has stopping piece 16 protruding, and because movement of the stored material is hindered, the storage material will not enter the region where container body 1 and lid body 14 are overlapping at the opening rotational limit, and therefore, the stored material can easily be removed from container body 1.

Furthermore, when beginning to rotate lid body 14, protruding piece 30 established in lid body 14 pushes away sound outputting protrusion piece 29 in the circumferential direction so that sound outputting protrusion piece 29 generates a noise. When lid body 14 has started to be rotated, one protrusion piece 30*a* pushes away noise outputting protrusion piece 29, and a noise is generated to notify that rotation has started, and when the rotational limit is approached, the other protrusion piece 30*b* pushes away noise outputting protrusion piece 29 and a noise is generated to notify that the completion of rotation is near.

Therefore, the user can audibly recognize when lid body 14 begins or is near completion of rotation, and a satisfactory feel of use from the storage container can be obtained.

Drawing 9 is a side view drawing showing the storage container. The top edge of tubular wall 2 of container body 1 has two concave sections 15. These concave sections 15 form a gap between lid body 14 in the closed condition and tubular wall 2, and this gap functions as a breather hole for air.

When storage material which require breathing, such as cosmetic puff applicators or the like, are stored in container body 1, the occurrence of mold on the cosmetic puff applicators can be prevented because of the breathability.

Drawing 10 is a half longitudinal cross-section drawing of number 2 container body 21 attached to container body 1. As shown in Drawing 10, number 2 container body 21 has screw threads 23 which assembled to screw grooves 18 of container body 1 in the upper outer wall of outer tube 22. The lower region of screw threads 23 has an overriding locking part 28 which protrudes in the outward direction and rides over protrusion 27 of container body 1.

No. 2 container body 21 forms an inner cone-shaped step 24 positioned slightly below the upper edge of outer tube 22, and that the same time establishes protrusion ring 25 which protrudes upward by said step 24, and is connected to concave shaped storage region 26 from this protrusion ring 25.

When screw threads 23 of number 2 container body 21 are screwed and assembled to screw grooves 18 of container body 1, extrusion ring 25 applies a consistent pressure along the whole circumference of packing piece 19 of container body 1, and number 2 container body 21 is hermetically assembled to container body 1.

Therefore, storage materials which require hermetic conditions like cosmetic materials can be stored in number 2 container body 21, and another type of storage material which is used at the same time can be stored separately in the same storage container, which is convenient.

Drawing 11 is a bottom view drawing of container body 1, and Drawing 12 is a top view drawing of number 2 container body 21. As shown in Drawing 11, the lower edge of the inner wall of the tubular wall 2 of container body 1 has three protrusions 27 which protrude inward at the same angle on the circumference of tubular wall 2. In this regard, the lower outer wall of screw threads 23 of number 2 container body 21 has three ride over locking parts 28 at identical angles to the three protrusions 27, and which make noise when riding over said protrusions 27.

As shown in Drawing 13, when number 2 container body 21 is screwed and assembled to container body 1, ride over locking parts 28 ride over protrusions 27 immediately before the screw assembly is completed so that after a clicking feel and a clicking sound is generated, the screw assembly of container body 1 and number 2 container body 21 is completed.

Therefore, the user will know that number 2 container body 21 is hermetically assembled either by audibly recognizing the sound generated or by the feel when ride over locking part 28 rides over protrusions 27, and therefore can know that number 2 container body 21 is positively assembled to container body 1.

In this example, number 2 container body 21 was made to and assembled to the bottom part of container body 1, but if there is only one storage material the number 2 container body 21 need not be established, and it is acceptable for only lid body 14 to be established on container body 1. Furthermore, in this example of tubular wall 2 was cylindrical, and the outer tube 22 of number 2 container body 21 was cylindrical similar to said cylindrical shaped tubular wall 2, and lid plate 8 of lid body 14 had a disk shape, but the present invention is not restricted to this case, and tubular wall 2 may be the rectangular in a shape which matches outer tube 22 and lid plate 8.

The present invention has the structure shown above, and therefore shows the following effects.

With the invention shown in Claim 1, with the locking rings of the cylindrical pin of the lid body locked together with the locking in ring of the tubular shaft of the container body, the cylindrical pin will fit into the tubular shaft, and that the same time the torque adjusting part will rub against the tubular shaft of the container body so that a suitable rotational torque can be adjusted, and the rotational tube of the lid body will fit around said tubular shaft, and because of the relative rotation between the cylindrical pin and the tubular shaft as well as said tubular shaft and the rotational tube, the lid body can be horizontally rotated with regards to the container body with a suitable resistance force, such that when the storage container is used, the user can obtain a pleasing feel.

Furthermore, because the lid body is rotated with regards to the container body using a double structure of the cylindrical pin to the tubular shaft and said tubular shaft to the rotation tube, the strength is increased and the durability and safety of the storage container can be increased.

The lid body rotates to open and close at a suitable rotational torque, so the lid body will not rotate in the opening direction by merely touching the lid body, and storage materials can be safely stored in the container body.

The rotation of the lid body is restricted to the designated positions by the contact of the locking pieces of the lid body to the locking parts of the container body, and therefore the user can clearly recognize the rotational limits of the lid body, and a stable feel of use can be obtained.

With the invention shown in Claim 2, the container body and the number 2 container body can store separate storage material, which is convenient.

With the invention shown in Claim 3, the rotation of the lid body can be stopped in a stable manner because the pair of locking parts of the container body and the pair of locking parts of the lid body contact together at an opening angle of less than 180° at the closing rotational limits and the opening rotational limits, and therefore the user can obtain a reliable feel.

Furthermore, even if an unreasonable force is applied to the lid body at the rotational limits of the lid body, the force applied to the contact region of the locking parts and the locking piece with the connecting region of the cylindrical pin to the tubular shaft and the tubular shaft to the rotation tube as a support point, will be received by the other locking piece and locking part because of the lever effect, and the effective force will not be applied to only one pair of locking piece and locking part, and therefore the durability and safety of the storage container is increased.

With the invention shown in Claim 4, a concave region is established in the container body which forms a gap together with the lid body at the close rotational limit, and this gap functions as a breather hole for air, which is suitable for the storage of storage materials which require breathability.

With the invention shown in Claim 5, a stopping piece protrudes from the bottom wall of the container body directly below the circumferential edge of the lid body which overlaps the container body at the opening rotational limits, and therefore storage material can be prevented from entering the region where the container body and the lid body overlap, so that removal of the storage material will be easy.

With the invention shown in Claim 6, hooking parts are established in the lid body which protrudes slightly in the outer direction from the container body, and therefore rotating and opening the lid body is easy and the storage container is easy to use.

With the invention shown in Claim 7, the container body and the number 2 container body are screwed together, and at the same time the protrusion rings which are formed on the inside of the outer tube of the number 2 container apply pressure consistently along the whole circumference of the packing piece established in the lower surface of the bottom wall of the container body, and therefore the container body and the number 2 container body can be assembled in an airtight condition.

With the invention shown in Claim 8, because ride over locking parts of the number 2 container body ride over the protrusions of the container body to produce a ride over quick feel and the ride over sound, the user can know by steering and feeling that the container body and the number 2 container body are screwed together in an airtight manner, and can therefore obtain security and satisfaction knowing that the number 2 container body is positively assembled to the container body, and can therefore obtain a good feeling of use.

With the invention shown in Claim 9, along with the rotation of the lid body, a protrusion piece pushes away a sound outputting protrusion piece of the container body in order to produce a sound, and therefore the user can hear the rotational opening or closing condition of the lid body, so that a feeling of satisfaction of using the storage container can be obtained.

With the invention shown in Claim 10, the locking protrusion pieces of the lid body contact the tubular wall of the container body at the opening rotational limits of the lid body, and therefore the rotation of the lid body can be stopped in a more stable manner.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended Claims all such changes and modifications that are within the scope of this invention.

What is claimed is:

1. A storage container comprising:

a) A container body comprising a tubular wall, said tubular wall having an inner wall; a bottom wall on said tubular wall; a small cylinder which has at least one locking part protruding from the inner wall which establishes a rotation limit; and a tubular shaft having an outer wall, wherein said tubular shaft has a smaller diameter than said small cylinder and which has a locking protrusion ring which protrudes inward from the lower part of the inner wall; and b) a lid which has a lid plate which closes off said tubular wall; a cylindrical pin in the lower surface of said lid plate which mates with said tubular shaft and which has a locking ring which locks with said locking protrusion ring; a torque adjusting protrusion to the outer side of said cylindrical pin with an inner wall which rubs against the outer wall of said tubular shaft in the longitudinal direction to control rotational torque; and a rotation tube which hangs down and locks around said tubular shaft and which has at least one locking tab on the outer wall which locks onto said locking part, such that the lid plate rotates horizontally with regard to the container body because of the relative rotation of said cylindrical pin to said tubular shaft and said tubular shaft to said rotation tube.

2. A storage container according to claim 1 which has a number 2 container body, wherein the bottom wall of the container body is established near the center in the longitudinal direction of the tubular wall, and screw grooves are established on the lower part of the inner wall of said bottom wall, said number 2 container body having an outer tube with substantially the same shape as said container body, a storage region inside of said outer tube, and a screw thread which screws into and attaches to said screw grooves.

3. A storage container according to claim 2 wherein a pair of locking tabs with an opening angle of less than 180° is established in the rotation tube of said lid; a first locking part which establishes the closing rotational limit and which contacts in the rotational direction one of the locking tabs on the small cylinder of the container body, a second locking part which establishes the opening rotational limit, and a third locking part which contacts in the rotational direction the other locking tab at said opening and closing rotational limit.

4. A storage container according to claim 3 which has at least one concave part established in the top edge of tubular wall of said container body which forms a gap with the closed condition lid.

5. A storage container according to claim 4 wherein a stopping piece which stops movement of a material stored inside said container body is established in the bottom wall of container body immediately below the outer edge of the lid which overlaps container body at the opening rotational limit.

6. The storage container according to claim 5 wherein a slightly protruding hooking part is established in the outer edge of the lid plate in the outer direction from container body.

7. A storage container according to claim 6 wherein a screw groove is cut into the inner wall of tubular wall in the bottom part of the bottom wall of container body, a packing piece is established in the lower surface of said bottom wall, a screw ring which screws to said screw groove is established in the outer wall of outer tube of number 2 container body, said protrusion ring forms an inner step positioned slightly below the top edge of said outer rube while pressing on said packing piece through said step in the closed condition, and said concave shaped storage part is connected from said protrusion ring.

8. A storage container according to claim 7 wherein a protrusion protrudes inward from the inner wall lower edge of tubular wall of container body, and a ride over locking part protrudes to said protrusion and produces a sound to indicate that the container body and the number 2 container body are screwed together.

9. A storage container according to claim 8 wherein a sound outputting protrusion piece protrudes from the inward side of small cylinder of container body, and has a top edge which can vibrate in the circumferential direction, and a protrusion piece protruding from the lid which pushes aside said sound outputting protrusion piece to generate sound.

10. A storage container according to claim 9 wherein a locking protrusion piece protrudes from the lower surface of lid to contact the upper edge of tubular wall of container body at the opening rotational limit of the lid.

* * * * *

UNITED STATES PATENT AND TRADEMARK OFFICE

CERTIFICATE OF CORRECTION

PATENT NO. : 6,988,630 B2
APPLICATION NO. : 10/602144
DATED : January 24, 2006
INVENTOR(S) : Matsumoto It is certified that error appears in the above-identified patent and that said Letters Patent is hereby corrected as shown below:

Column 12, Line 36 Delete “rube”, Insert –tube--

Signed and Sealed this

Fifteenth Day of August, 2006

JON W. DUDAS
*Director of the United States Patent and Trademark Office*